United States Patent [19]

Harteman

[11] Patent Number: 4,532,154

[45] Date of Patent: Jul. 30, 1985

[54] PROCESS FOR MAKING A SIZED MULTIFILAMENT YARN OF AN AROMATIC POLYAMIDE

[75] Inventor: Evert Harteman, Arnhem, Netherlands

[73] Assignee: Akzo NV, Arnhem, Netherlands

[21] Appl. No.: 599,676

[22] Filed: Apr. 12, 1984

Related U.S. Application Data

[62] Division of Ser. No. 323,566, Nov. 20, 1981, Pat. No. 4,455,341.

[30] Foreign Application Priority Data

Nov. 24, 1980 [NL] Netherlands ..... 8006393

[51] Int. Cl.[3] ..... B05D 3/12; B05D 7/02

[52] U.S. Cl. ..... 427/175; 57/297; 427/177; 427/299; 427/316; 427/412; 427/416

[58] Field of Search ..... 428/395; 427/175, 177, 427/299, 316, 412, 416; 57/242, 251, 297

[56] References Cited

U.S. PATENT DOCUMENTS

| | | | |
|---|---|---|---|
| 3,120,452 | 2/1964 | Moser et al. | 428/395 |
| 3,393,210 | 7/1968 | Speck | 528/340 X |
| 3,498,821 | 3/1970 | Hanson | 428/375 |
| 3,546,008 | 12/1970 | Shields et al. | 428/395 |
| 3,600,269 | 8/1971 | Daniels | 428/394 X |
| 4,033,922 | 7/1977 | Baron, Jr. et al. | 252/8.6 X |
| 4,034,138 | 7/1977 | Babayan | 428/395 X |
| 4,098,741 | 7/1978 | Login | 428/395 X |
| 4,145,461 | 3/1979 | Lerman et al. | 428/395 X |
| 4,259,457 | 3/1981 | Login | 428/395 X |
| 4,320,823 | 3/1982 | Covaleski | 428/243 X |
| 4,368,615 | 1/1983 | Lammers | 428/395 X |
| 4,438,060 | 3/1984 | Reinehr et al. | 428/398 X |

OTHER PUBLICATIONS

Baumeister, T. et al., (Ed.), "Marks' Standard Handbook for Mechanical Engineers", eighth edition, New York, McGraw-Hill Book Company, 1978, pp. 1-38.

*Primary Examiner*—Evan K. Lawrence

*Attorney, Agent, or Firm*—Stevens, Davis, Miller & Mosher

[57] ABSTRACT

A multifilament yarn of an aromatic polyamide, in particular poly-p-phenylene terephthalamide, having a tenacity of at least 15 cN/dtex and an initial modulus of at least 400 cN/dtex is provided with a water-soluble size, the filaments of the yarn having a cohesion corresponding to a Manra number not higher than 40. The yarn is made by subjecting a non-sized yarn having a moisture content which is lower than its equilibrium moisture content, while under a tension of at most 0.25 cN/dtex, to a continuous wetting treatment with an aqueous solution of a size and subsequently winding the treated yarn into a yarn package. The yarn package contains a single continuous length of the sized yarn. The sized yarn is suitable as warp and weft yarn in the weaving industry.

6 Claims, No Drawings

PROCESS FOR MAKING A SIZED MULTIFILAMENT YARN OF AN AROMATIC POLYAMIDE

This is a division of application Ser. No. 323,566 filed Nov. 20, 1981, U.S. Pat. No. 4,455,341.

The invention relates to a process for the manufacture of a multifilament yarn of an aromatic polyamide having a tenacity of at least 15 cN(centinewtons)/dtex and an initial modulus of at least 400 cN/dtex.

Multifilament yarns of an aromatic polyamide having a high tenacity and a high modulus are generally known. The weaving of such yarns presents great problems. Notably untwisted multifilament yarns of poly-p-phenylene terephthalamide, cannot at all or only with difficulty be woven into fabrics on conventional looms. Increasing the cohesion of the single filaments of such a multifilament yarn by twisting has the disadvantage that the initial modulus of the yarn decreases too much. More particularly, it is therefore not possible to prepare a weft yarn which can be processed on all conventional looms. Because of the problems regarding their processability multifilament yarns of aromatic polyamides having a high tenacity and a high initial modulus have not yet found application on a large scale in the weaving industry. It is therefore an object of the present invention to provide a process for making a yarn that does not display the drawbacks of the known aromatic polyamide multifilament yarns having a high tenacity and a high initial modulus, and is suitable for use in the weaving industry. The foregoing object and others are accomplished in accordance with this invention.

The invention is characterized in that the yarn of the type indicated above is provided with a water-soluble size and the filaments of the yarn display a cohesion corrsponding to a Manra number not higher than 40.

Owing to the very good cohesion among the single filaments of the yarn according to the invention it can excellently be used both in the warp and in the weft of a fabric.

The yarn may consist of any aromatic polyamide suitable for use as starting material for the preparation of yarns having a high tenacity and a high initial modulus.

Aromatic polyamides within the scope of the present invention include polyamides that are entirely or substantially made up of recurring units of the general formula $$-\underset{\underset{O}{\|}}{C}-A_1-\underset{\underset{O}{\|}}{C}-,\ -\underset{\underset{H}{|}}{N}-A_2-\underset{\underset{H}{|}}{N}-\ \text{and/or}\ -\underset{\underset{O}{\|}}{C}-A_3-\underset{\underset{H}{|}}{N}-$$

wherein $A_1$, $A_2$ and $A_3$ are the same of different and represent divalent, one or more aromatic nuclei-containing hard segments, which may contain a heterocyclic ring or not, of which segments the chain extending bonds are in the para position relative to each other or parallelly or oppositely directed. Examples of such segments include 1,4-phenylene, 4,4-diphenylene, 1,5-naphthalene and 2,6-naphthalene. They may be substituted or not with, for instance, halogen atoms and/or alkyl groups. The chain molecules of the aromatic polyamides may contain, in addition to amide groups and the above-mentioned aromatic segments, 35 mole % of other groups, such as m-phenylene groups, nonrigid segments, such as alkyl groups, or ether groups, urea groups or ester groups. It is preferred that the yarn according to the invention should entirely or substantially consist of poly-p-phenylene terephthalamide.

A survey of the preparation of poly-p-phenylene terephthalamide and the process of spinning it into yarns having a high tenacity and a high initial modulus is given in Kirk-Othmer, Encyclopedia of Chemical Technology, 3rd Ed., Vol. 3 (1978), pp. 213–242. The cohesion of the yarn according to the invention is characterized quantitatively on the basis of the Manra number. A low value of the Manra number is indicative of a high degree of cohesion. It has been found that the yarn according to the invention can be satisfactorily woven into a fabric if the filaments of the yarn have a cohesion which corresponds to a Manra number of 40 or lower. By preference the yarn has a Manra number not higher than 20. The cohesiveness of the yarn also may be determined by the so-called cutting test. This cutting test will be further described hereinafter. So the cohesiveness of the yarn may be characterized by either the Manra number or by the results of the cutting test.

The yarn may be twisted or not. By preference it is entirely or practically free from twist. If desired, the filaments of the yarn may be interconnected by tangling.

The sizing agent with which the yarn is provided is soluble in water. This means that by simply washing the yarn with warm water, possibly at a pH higher than 8, the size may entirely or largely be removed. It is preferred that the size should be a film-forming polymer. Examples of film-forming polymers that may be used within the scope of the present invention include polymers built up from acrylic acid or its derivatives, such as polyacrylic acid and polymethacrylic acid. Instead of these polyacrylate resins there may be used polyesters derived from at least a dicarboxylic acid, at least a diol and a sulphonated dicarboxylic acid. Sizing agents of this type are disclosed in U.S. Pat. No. 3,546,008. It is preferred that the sizing agent to be used should be a polyester derived from isophthalic acid, diethylene glycol and sulphonated isophthalic acid. Such a polyester is commercially available under the trade name Eastman WD.

The yarn manufactured according to the process of the invention should contain the size in an amount such that on the one hand satisfactory cohesion is imparted to the filaments and on the other the yarn remains sufficiently flexible and leaves no or hardly any deposits on thread guiding elements. These requirements can generally be satisfied, provided that the yarn has a size content of from 0.5–10% by weight.

In addition to being coated with a size of a film-forming polymer the yarn may be provided with 0.5–15% by weight of a non-ionic wax. It is preferred that the non-ionic wax should consist of a triglyceride of a fatty acid having 18 carbon atoms and containing 6 to 10 epoxy groups. This type of product is commercially available under the trade name Sopromine CF. The non-ionic wax may contain a substance, e.g. 5 percent by weight of polydimethylsiloxane, which further decreases the friction between the yarn and the yarn guiding elements.

The yarn has a tenacity which may range from 15 cN/dtex to 35 cN/dtex or even higher. The initial modulus of the yarn may range from 400 cN/dtex to 1300 cN/dtex or even higher.

The yarn may have any linear density and be composed of any number of filaments currently used in actual practice.

Generally, the yarn has a linear density of tex 1–1000 and is composed of 10–5000 filaments. It is preferred that the yarn according to the invention should have a linear density of tex 5–200 and be composed of 100–2000 filaments. The yarn is excellently suitable to be used as weaving yarn. It can be supplied in the form of the normal loom beams which contain a large number of adjacent continuous lengths of yarn. By preference the yarn is supplied in the form of a yarn package containing only a single continuous length of yarn. The yarn wound into such a package is particularly suitable to be used as weft in the manufacture of a woven fabric. The sized weft yarn according to the invention can readily be cut. A corresponding yarn which has only been oiled and/or twisted is only cuttable with special equipment.

Yarn wound into packages containing a single continuous length of yarn is also suitable to be used as warp on loom beams. In that case there is no need for it to be subjected to a sizing treatment on large and costly, slowly running machines, as is the practice required in accordance with the state of the art. Woven fabrics in which the warp and/or the weft consist(s) of the yarn have an attractive appearance and display no or only very few cloth faults.

The process of the invention is characterized in that a multifilament yarn of an aromatic polyamide having a tenacity of at least 15 cN/dtex, an initial modulus of at least 400 cN/dtex and a moisture content which is lower than the equilibrium moisture content of the yarn is subjected, while under a tension of at most 0.25 cN/dtex, to a continuous wetting treatment with an aqueous solution of a size and the yarn is subsequently wound into a yarn package.

The process according to the invention provides a sized yarn that can be satisfactorily woven into a fabric without there being any need for using the conventional sizing methods. In the conventional sizing processes use is made of a sheet of many, usually thousands of adjacent threads which are successively wetted with a size solution, the excess of which is squeezed off, after which they are passed through a drying compartment. This kind of treatment is expensive and both time and energy consuming. The process according to the invention makes it possible with simple means, there being no need for using costly machines, and in a rapid process to manufacture yarn packages containing a multifilament yarn of an aromatic polyamide having a tenacity of at least 15 cN/dtex and an initial modulus of at least 400 cN/dtex which is provided with a water soluble size and whose constituent filaments have a cohesion which corresponds to a Manra number not higher than 40. Thus it has become possible for yarns having a high tenacity and a high initial modulus to be rendered suitable for weaving purposes, more particularly to be used as weft.

It should be added that from British Patent Specification No. 1,285,585 it is known to apply a size from an aqueous solution to a heated multifilament yarn travelling at a high speed and subsequently causing the water to evaporate from said solution under the influence of the heat imparted to the yarn by heating it. In this publication mention is made of polyamides, such as polyhexamethylene adipamide. Said British patent specification makes no mention of yarns of aromatic polyamides having a tenacity higher than 15 cN/dtex and an initial modulus higher than 400 cN/dtex, which are to satisfy very special requirements as regards interfilament bonding in order to permit being woven into a fabric. Nor does it disclose the conditions that are essential to the process of the present invention, viz. a yarn tension during wetting not higher than 0.25 cN/dtex and a Manra number of the sized yarn not higher than 40. In the process according to the invention the size is applied to a yarn that has a moisture content which is lower than the equilibrium moisture content of the yarn, as a result of which the yarn is still capable of absorbing some amount of water.

It was surprising that it was found possible for the yarn obtained by the process according to the invention to be wound into a package without having to be dried again, i.e. while still in a somewhat wet state, and yet to unwind satisfactorily without displaying any sticking, so that it is satisfactorily processable into a woven fabric. It is assumed that the aromatic polyamide absorbs part of the water contained in the size solution applied to the yarn, so that the water largely disappears from the surface thereof.

A non-sticking and satisfactorily unwinding product is obtained even if during its winding into a package up to 50% of the moisture originally applied to the yarn is still present.

Yarn having a moisture content lower than the equilibrium moisture content may be obtained by drying. Such drying is preferably carried out immediately before applying the size, so that absorption of moisture from the ambient is reduced to a minimum. Drying the yarn is preferably done by heating. The yarn may be heated in the usual manner, for instance by means of a hot plate or pin, a hot inert gas, infrared radiation, etc. A very suitable means is a hot roll. The temperature of the yarn at the moment it comes into contact with the aqueous solution of the size does not play a critical role. The temperature may be room temperature or a higher or lower temperature.

The process according to the invention is preferably so carried out that a substantially twistless yarn of poly-p-phenylene terephthalamide is successively passed over a feed roll and a hot roll heated to a temperature of 300° to 500° C., with the yarn tension between the feed roll and the hot roll being at least 0.5 cN/dtex, but below the value at which the single filaments break, and subsequently over a non-heated discharge roll, after which the yarn is wetted with an aqueous solution of the size by means of a rotating applicator roll, followed by winding the yarn.

As the yarn passes over the hot roll, it is dried and the spinfinish present on the yarn partly or entirely evaporates. The most favourable results are obtained if a minimum amount of spinfinish is left on the yarn. Use is preferably made of a starting yarn containing a spinfinish which entirely evaporates or decomposes as it passes over the hot roll. Between the feed roll and the hot roll the yarn may be subjected to a drawing treatment, if desired. The temperature of the hot roll and the speed of the passing yarn should be so adapted to each other that when the yarn leaves the hot roll it has a moisture content which is lower than the equilibrium moisture content of the treated yarn under its winding conditions. At normal room temperature the equilibrium moisture content of poly-p-phenylene terephthalamide may range from about 3 to 7% by weight.

Wetting the yarn with the solution of the size may be done with the aid of known liquid applicators. A convenient device to that end is an applicator roll whose surface moves into contact with the yarn in the direction of travel of the yarn or in opposite direction. It is preferred that the yarn should pass over the applicator roll via an annular groove provided in the surface thereof, which groove has a substantially rectangular cross-section. In the groove the yarn is completely surrounded by the solution of the size, so that the solution can penetrate into the yarn on all sides thereof. The groove is preferably so widely dimensioned that no filaments will run over the part of surface of the applicator roll outside the groove. Should the width of the groove be chosen unduly great, then the filament bundle would be wetted less effectively. In a sufficiently narrow groove the filament bundle is subject to some squeezing action, which results in effective and uniform penetration of the size into the yarn.

The applicator roll and the groove in it are wetted with the aqueous solution of the size in a usual manner, for instance in that the rotating applicator roll is partially immersed in the solution of the size. The size is preferably applied as a 20 to 40 percent by weight aqueous solution of a polyester derived from isophthalic acid, diethylene glycol and sulphonated isophthalic acid.

Before the size is applied, the twistless yarn may be subjected to a tangling treatment, in which the single filaments of the yarn are intermingled to some degree.

After the size is applied to the yarn and before it is wound, it may still be provided with a non-ionic wax. As a result, processability of the yarn in weaving it into a fabric is even further improved.

The non-ionic wax may be applied in a usual manner. A convenient device to that end is a heated applicator roll. Alternatively, the wax may be applied by passing the yarn over a lump of solid wax.

In the process according to the invention the speed of the yarn may range from 10 to 500 m/min. It is preferred that the speed should be 100–300 m/min.

In the process according to the invention the yarn may, before or after application of the size, still be provided with the usual aids, such as surface active substances, anti-static agents or other commonly used finish ingredients.

Although the tension during wetting with the size solution and during the subsequent winding into a yarn package is at most 0.25 cN/dtex, a certain minimum yarn tension will, of course, be necessary to obtain a good yarn package. Also the distance between the size applicator and the winding device may be adapted to obtain a high quality product. A man skilled in the art will be able to choose these and other process conditions in order to obtain the most favourable results.

The process according to the invention may be combined with conventional spinning processes and/or aftertreatments. For instance, the process according to the invention may be combined with a heat treatment of the yarn to increase the initial modulus.

In that case a metering system for applying the size solution may simply be placed downstream of the heating element.

The tenacity and the initial modulus of the yarn in conformity with ASTM D885 are measured on a yarn bundle with the aid of an Instron tensile tester (Instron Engineering Corp., Canton, Mass., U.S.A.).

Before carrying out the tests the test specimens are all conditioned for 16 hours at a temperature of 20° C. and a relative humidity of 65%. The measurements are carried out in an identically conditioned space. The tensile tests are carried out five times on samples having a nominal gauge length of 50 cm and at a constant rate of specimen extension of 5 cm/min.

The linear density of a yarn is determined by weighing a particular yarn length (100 cm under a tension of 0.1 cN/dtex). The Manra number is determined as follows.

Use is made of the Manra yarn filament counter developed by The British Rayon Research Association and made by Newmark Instrument Ltd. This instrument had originally been developed for counting the number of filaments in a multifilament yarn. It is described in British Patent Specification No. 829,330 and in Man-Made Textiles, March 1958, pp. 38–39. Its operation is in principle as follows. A multifilament yarn extending between and held by two clamps is progressively cut by a cutting blade. Each time one of the separate filaments of the yarn is cut, there is produced a small change in tension, which is converted into an electric pulse. The total number of pulses produced in completely severing the yarn is registered. In the case of a non-sized yarn composed of loose filaments the number of pulses registered will generally be equal to the total number of filaments in the yarn. If, however, all filaments of a multifilament yarn are bonded together by a size, then the Manra filament counter will register only one pulse.

To permit comparison of yarns composed of different numbers of filaments use is made of a quantity, viz. the Manra number, derived from the number of pulses registered. Such quantity is defined as follows:

$$\text{Manra number} = (A-1)/(T-1)\cdot 100$$

where A is the number of pulses registered by the Manra filament counter and T is the total number of filaments in the yarn.

The apparatus which is to be used in determining the Manra number should be adapted to the number of filaments in the yarn. An apparatus suitable for counting up to 1000 pulses can always be used for testing yarns having up to about 2000 filaments. If the number of pulses exceeds the maximum number the apparatus can count, then use may be made of the cutting test.

Whereas the Manra number 0 denotes that interfilament bonding is 100%, the Manra number 100 indicates that there is no interfilament bonding at all. In determining the Manra number of the yarn according to the invention the results of 10 test runs carried out with the use of the Manra counter are averaged.

Instead of measuring the cohesion of the yarn according to the invention with the Manra counter, it may be determined by using the cutting test. Its procedure is simpler than that of the Manra test, so that it is very suitable for use in actual practice. The cutting test is carried out as follows.

A yarn sample 40 cm long is vertically suspended over a table. Its top end is secured in a clamp. To the free, lower end of the sample there is attached such a weight that the tension in the yarn sample is 1 cN/dtex. Subsequently, the yarn sample is cut in half, i.e. about 20 cm below the point of suspension. Next, of the remaining suspended upper half of the sample the length and the greatest width are measured of the possibly flared, newly formed end at the point where the yarn was cut through. The extent to which the yarn has opened longitudinally and transversely as a result of its having been cut through under the abovementioned tension is indicative of the degree of cohesion of the filaments. A twistless, non-sized multifilament yarn subjected to a cutting test generally shows an opened end about 80 mm long and having a greatest width of about 20 mm. Upon being subjected to a cutting test, the yarn according to the invention, which has a Manra number not higher than 40, generally displays an opened end having a length of not more than 30 mm and a greatest width of not more than 10 mm. So the yarn of the present invention is characterized either by a Manra number not higher than 40 or by the cutting test resulting in an opened end having a length of not more than 30 mm and a greatest width of not more than 10 mm. It is preferred that of the opened end the length should not be more than 10 mm and the greatest width not be more than 2 mm. If the yarn is tangled, the sample should be cut just above a tangled region. The cutting test is carried out 10 times and the results are averaged.

The invention will be further described in the following examples.

EXAMPLE I

A twistless poly-p-phenylene terephthalamide yarn containing 0.8% by weight of a spin finish of butane diol-1,4-dioleate provided with ethylene oxide groups (trade name Leomin OR), which yarn was made up of 250 filaments having a total linear density of dtex 420 and a tenacity of 18.5 cN/dtex and an initial modulus of 450 cN/dtex, was subjected to the following continuously conducted treatment.

The yarn made 10 wraps around a first unheated feed roll operating at about 160 m/min., from which it proceeded to a second feed roll around which it again made 10 wraps. This second feed roll was heated to a temperature of 400° C. and its speed was so set that the tension in the yarn between the first and the second feed roll was approximately 500 cN. After leaving the heated roll the yarn passed over a first rotating applicator roll by which the yarn was wetted with a small amount of water to which 0.05% by weight of a surfactant, viz. sodium-di-octylsulphosuccinate (trade name Aerosol OT), had been added. This wetting treatment served to prevent the yarn from getting electrostatically charged. The yarn subsequently made 10 wraps around a third unheated feed roll operating at such a circumferential speed that the yarn tension between the second and the third feed roll was 500 cN. Next, the yarn ran through a groove provided in the circumference of a rotating second applicator roll, which groove had a rectangular crosssection, a width of 0.3 mm and a depth of 0.7 mm.

This second applicator roll was partially immersed in an aqueous size solution of 30% by weight of the commercial Eastman WD product. Eastman WD is a polymer consisting of a sulphonated linear polyester of isophthalic acid and diethylene glycol. The weight average molecular weight of the polymer is about 12000, it being built up of about 40 monomeric units. The sulphur content of the dry polymer is 1.18% by weight.

As the yarn passed over the second applicator roll, it absorbed such an amount of the aqueous size solution as resulted in a size-on-yarn loading of 2.0% by weight. Finally, the yarn was passed via two rolls having a polytetrafluoroethylene surface to a winding device and wound into a yarn package. The tension in the yarn as it passed over the second applicator roll was in the range of 50 to 75 cN.

The windings of the resulting yarn package were found not to stick together. Nor were they found to stick together after two week's storage. The Manra number of the yarn was 10. The results of the cutting test were: length 1 mm, greatest width 1 mm. The yarn was processed into a fabric having a width of 1 m on a Saurer loom. The yarn was found to be well processable.

EXAMPLE II

The same procedure was used as in Example I, except that between the third unheated feed roll and the second applicator roll the yarn was treated with a tangling device of the type described in U.S. Pat. No. 3,115,691. The Manra number of the sized yarn thus treated was 8. The yarn was found to be satisfactorily weavable.

EXAMPLE III

The same procedure was used as in Example I, except that after leaving the second applicator roll the yarn passed over a third applicator roll, which was immersed in the melt of a non-ionic wax known as Sopromine CF. This is a commercial product consisting of a triglyceride of a fatty acid having 18 carbon atoms and containing 6 to 10 ethylene oxide groups. The yarn absorbed 1% by weight of this wax. The yarn had a Manra number 6 and could very satisfactorily be woven into a fabric.

EXAMPLE IV (COMPARATIVE)

The same procedure was used as in Example II, except that no size was applied to the yarn. The Manra number of the tangled, non-sized yarn was 95. The results of the cutting test were: length 70 mm, greatest width 15 mm. It was found impossible for it to be woven into a fabric.

EXAMPLE V (COMPARATIVE)

The twistless yarn used as starting yarn in Example I was twisted to 100 turns/m. The Manra number of the resulting, non-sized yarn was 92. It was found impossible for the yarn to be woven into a fabric.

I claim:

1. A process for the manufacture of a multifilament yarn provided with a water-soluble size selected from the group of film-forming materials consisting of polymers built up from acrylic acid or its derivatives and polyesters derived from at least a dicarboxylic acid, at least a diol and a sulphonated dicarboxylic acid, the filaments of the sized yarn having a cohesion corresponding to a Manra number not higher than 40, said process being characterized in that a multifilament yarn of an aromatic polyamide having a tenacity of at least 15 cN/dtex, an initial modulus of at least 400 cn/dtex, and a moisture content which is lower than the equilibrium moisture content of the yarn, is subjected, while under a tension of at most 0.25 cN/dtex, to a continuous wetting treatment with an aqueous solution of a size as aforesaid, and the yarn is subsequently wound into a yarn package.

2. A process according to claim 1, characterized in that a substantially twistless yarn of poly-p-phenylene terephthalamide is successively passed over a feed roll and a hot roll heated to a temperature of 300° to 500° C., with the yarn tension between the feed roll and the hot roll being at least 0.5 cN/dtex, but below the value at which the single filaments break, and subsequently over a non-heated discharge roll, after which the yarn is wetted with said aqueous solution of the size by means of a rotating applicator roll, followed by winding the yarn into said yarn package.

3. A process according to claim 2, characterized in that the yarn passes over the applicator roll via an annular groove provided in the surface thereof, which groove has a substantially rectangular cross-section.

4. A process according to claim 1, 2 or 3, characterized in that the size is applied as a 20 to 40 percent by weight aqueous solution of a polyester derived from isophthalic acid, diethylene glycol and sulphonated isophthalic acid.

5. A process according to claim 1, 2 or 3, characterized in that before the size is applied, the yarn is tangled.

6. A process according to claim 1, 2 or 3, characterized in that after the size is applied, the yarn is provided with a non-ionic wax with the aid of an applicator roll.

* * * * *